United States Patent [19]

Crawford

[11] 4,201,322

[45] May 6, 1980

[54] BOTTLE CARRIER

[75] Inventor: Kenneth Z. Crawford, Crawfordsville, Ind.

[73] Assignee: Polycarrier Company, Crawfordsville, Ind.

[21] Appl. No.: 897,412

[22] Filed: Apr. 18, 1978

[51] Int. Cl.[2] ..... B65D 71/00

[52] U.S. Cl. ..... 224/45 AB; 206/183; 229/28 BC

[58] Field of Search ..... 224/45 A, 45 AB, 48 R, 224/48 C; 206/163, 165, 173, 186, 189, 170, 172, 194, 166; 229/52 BC, 41 R, 24 R, 28 BC, 28 R; 220/4 F, 6, 94 R

[56] References Cited

U.S. PATENT DOCUMENTS

| | | | |
|---|---|---|---|
| 2,304,683 | 12/1942 | Finn et al. | 206/189 |
| 2,335,022 | 11/1943 | O'Reilly | 224/45 AB |
| 2,457,307 | 12/1948 | Hall et al. | 206/165 |
| 2,609,981 | 9/1952 | Bolding | 206/183 |
| 2,711,843 | 6/1955 | Van Rosen et al. | 206/189 |
| 3,039,651 | 6/1962 | Lang | 206/172 |
| 3,495,734 | 2/1970 | Hanna et al. | 206/183 |
| 3,773,214 | 11/1973 | Lemon | 206/194 |
| 3,780,906 | 12/1973 | Katzenmeyer | 206/170 |
| 3,815,732 | 6/1974 | Klygis et al. | 206/163 |
| 3,820,657 | 6/1974 | Klygis et al. | 206/166 |

*Primary Examiner*—Kenneth W. Noland

*Attorney, Agent, or Firm*—Jenkins, Coffey, Hyland, Badger & Conard

[57] ABSTRACT

A carrier for two rows of one or more bottles, made of die-cut plastic sheet. Two bottom panels extend between upright center and outer-face panels. The center panel(s) connect directly to top handle elements and the outer face panels connect thereto through top panels formed of bottle-separator strips. Lift struts integral with bottom and center panels extend from the outer halves of the bottom panels, upward and inward, across the center planes of the bottles to the handle, so as to separate the bottoms of the bottles, and to form primary lift elements from the bottom of the bottles to the handle. Two other lift trains connect the handle to the bottom panels, an inner one through the center panels and an outer one through the top and outer face panels. Such elements confine and protect each bottle on all four sides. The carrier is made collapsible by selected geometric relationships of the panels and struts and by varying the effective lengths of one or more lift train elements relative to the handle position, preferably by sliding the handle elements of one or preferably both the center panel(s) and the lift struts relative to other handle elements. The carrier is held erected by interlocking the handle elements, and by the stiffening effect of the lift struts.

42 Claims, 19 Drawing Figures

BOTTLE CARRIER

This invention relates to carriers for bottles and the like, and especially to manually transportable carriers adapted to contain a plurality of bottles and in which the bottles and the carriers are both adapted to be reused repeatedly in the distribution and sale of beverages, for example, soft drinks and beer.

It is the general purpose of the invention to provide carriers which will provide to a high degree the various characteristics desired or required by the different persons or agencies involved in the manufacture, distribution and sale of such carriers and beverages. It is a special object of the invention to provide such carriers which may be made of plastics sheet stock, such as polyethylene, polypropylene, and other polyolefins. Such polyolefins have especially desirable properties for this application; they have high resistance to tearing, cracking, and breaking over a wide temperature range, they may be scored to form hinge and bend lines and can be creased for stiffness, and they are relatively impervious to damage from liquids and chemicals so as to withstand adverse conditions of use and to permit cleaning and reuse over a long service life.

For the carrier manufacturer: The invention provides carriers which can be made by a small number of simple steps such as die cutting, folding, stapling, and the like. They can be made to fit any size bottle and to accommodate any reasonable number of bottles. The carrier blanks can be cut from sheet stock not substantially wider than the carrier width, with a minimum of waste, so as to give economical use of material. Further, the carriers can be assembled in flat collapsed condition, and can be stored and shipped in such condition.

For the bottler and distributor: The carriers can be stored in compact flat condition, both originally from the manufacturer and after being returned from use and cleaned. They are easily collapsed and erected, and take a self-sustaining, erected condition which adapts them to be placed in cases and loaded by standard automatic loading machines. They permit the loaded cases to be stacked as on pallets during handling and distribution both of filled bottles and of returned empty bottles. They provide attractive dress for the product and ample panel space for identifying and promotional printing and decoration.

For the retailer and consumer: The invention provides carriers of attractive appearance and sturdy construction, well adapted for convenient and effective display. They are convenient and long-lived in handling by the consumer, both in carrying the bottled product from the store to the home and in collecting and returning the empty bottles for reuse.

In the hands of all involved, the bottle carriers in accordance with the present invention are especially useful and sturdy, are well adapted to withstand the hard use and wetness and other adverse conditions encountered in use, and can be made attractive and with high and large outside face panels for effective display of trademarks and other identifying and promotional indicia and decoration.

In accordance with the invention, a carrier for two rows of one or more bottles has two horizontal bottom panels for supporting the bottoms of the bottles. Such panels extend oppositely outward from a center panel or panels which lead upward to top handle means, preferably a handle layer integral with each center panel.

The outer edges of the bottom panels are connected to upright outer face panels which at the top are connected to top panels formed of spaced separator strips which define one or more bottle openings therein. The separator strips extend inward and desirably upward to the center of the carrier and are there connected to handle means, preferably a handle layer attached to the top of each top panel.

Lift struts are connected to the bottom panels at points spaced longitudinally of the bottle rows and within the outer halves of the bottom panels so as to be within the outer halves of the bottle positions thereon. From such connection points, the struts extend upward and inward across the center plane of the bottle row and are connected at their upper ends for lift by the handle means. Preferably, the upper ends of the struts are connected to a handle layer, either their own or that of another element of the carrier. Such lift struts form retaining elements at the opposite sides of the bottles, and separate and protect the bottles from adjacent bottles in each row.

Handle lift force is transmitted from the handle structure to the carrier bottom panels through three lift trains, one by way of the center panel to the inner peripheries of the bottom panels, a second by way of the sloping top panel and vertical outer face panel, and a third by way of the lift struts, extending straight from a handle connection downward and outward to points within the outer halves of the bottle positions on the bottom panels. Desirably, the lift struts and the separator strips forming the top panel, and preferably also portions of the outer face panels, are of sufficient stiffness to hold an erected carrier in a predetermined configuration having considerable rigidity, sufficient to adapt the carriers for automatic loading in multiple-bottle loading machines. When the carriers are made of sheet stock, such stiffners may be provided by forming the elements of the carrier with longitudinal creases or bend lines which stiffen such elements so that they serve as struts.

The carriers are thus composed of a series of straight elements, which are desirably connected by hinge or bend lines and are arranged in a geometric pattern which permits the carriers to be collapsed by folding the bottom panels upward about the hinge lines between their outer edges and the outer face panels. Such collapsing is made possible by making at least one and preferably both of the handle elements connected to the center panels and lift struts slidable relative to the handle elements connected to the top panels. The carrier is locked in erected condition by locking the relatively movable handle elements against movement when the carrier is erected. The handle locking means may take various forms. In one preferred form, one of the handle layers is provided with a handle flap which is wrapped across the top of other handle layers and thence through hand grip openings in the several layers. The locking flap also forms a smooth hand grip for lifting the carrier.

In further accordance with the invention, the carrier can be, and desirably is, made of sheet stock, as of polyolefin or other plastics material. The several panels and struts and handle elements can all be die cut as parts of sheet stock blanks, and connections between adjoining elements provided by heat scoring the blanks to form hinge or bend lines in the blanks. The top panel strips, the lift struts, and other elements can be stiffened by heat forming the sheet stock with elongated crease lines or bend lines. Preferably, the carrier may comprise two similar blanks, each having, in connected series: an outer handle layer, a top panel, an outer face panel, a bottom panel, and a center panel. One or both blanks also have a handle layer connected to the center panel. When the blanks are for a two-bottle carrier, lift struts are cut from material at the margins of the center panel and the inner halves of the bottom panels. When the blanks are for a carrier having more than one bottle position in each row, lift struts are cut not only from such marginal material but also from material between the bottle positions in the center panel and bottom panel, which leaves slots in the blank.

Carriers may be assembled from such blanks by (a) laying one blank on the other; (b) fastening the blanks together, as by stapling, at selected locations, e.g., the center panels; (c) folding the free ends of the blanks against opposite sides of the fastened ends; and (d) fastening the free handle ends of the blank together, as by stapling, in cooperative relation. Depending on the geometry of the carrier elements (e) the struts are stapled either to a separate handle element or to one or more handle elements of the other parts. The assemblies thus formed in flat condition are complete and need not be opened or erected until it is desired to erect them for use.

The accompanying drawings illustrate the invention and show a number of modifications exemplifying the best mode of carrying out the invention as presently perceived. In such drawings:

FIG. 1 is a perspective view of a two-bottle carrier which collapses with sliding movement in opposite directions of a center panel handle layer and a lift strut handle layer relative to outer handle layers connected to the top panels;

FIG. 1-A is a perspective view of the opposite side of the handle structure of FIG. 1;

Figure 1:
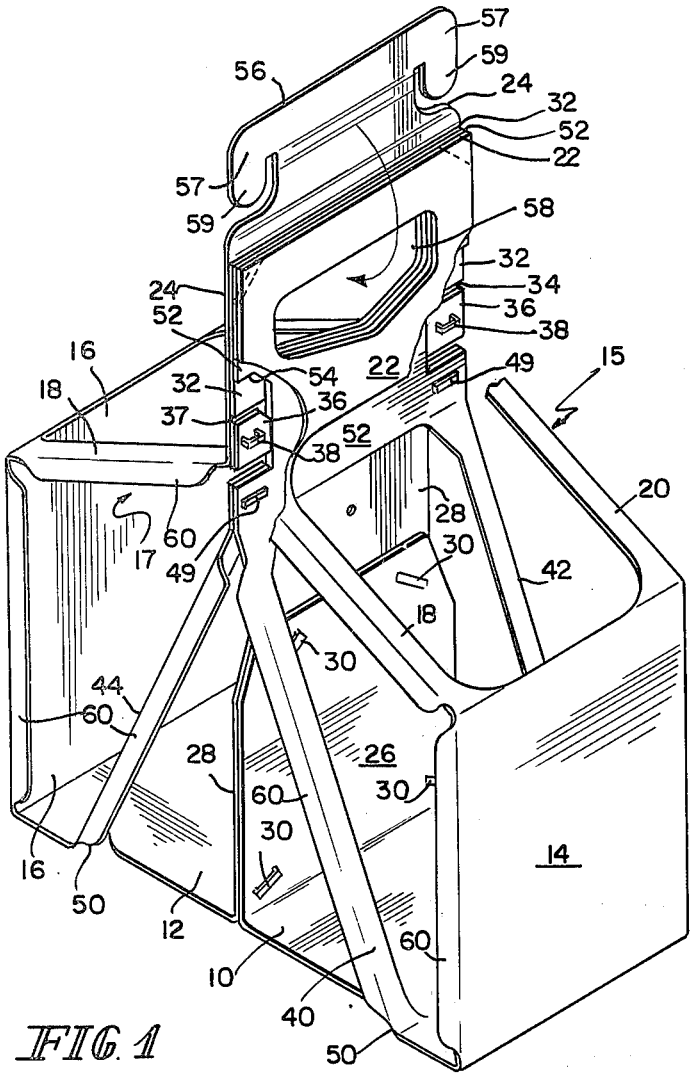
Figure 1A:
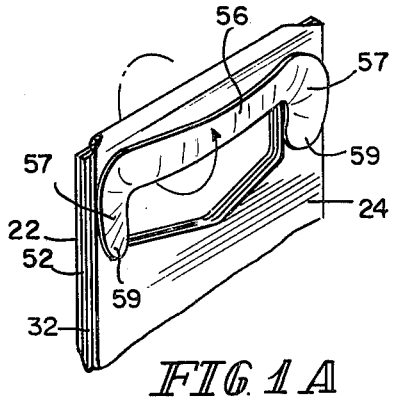
Figure 2:
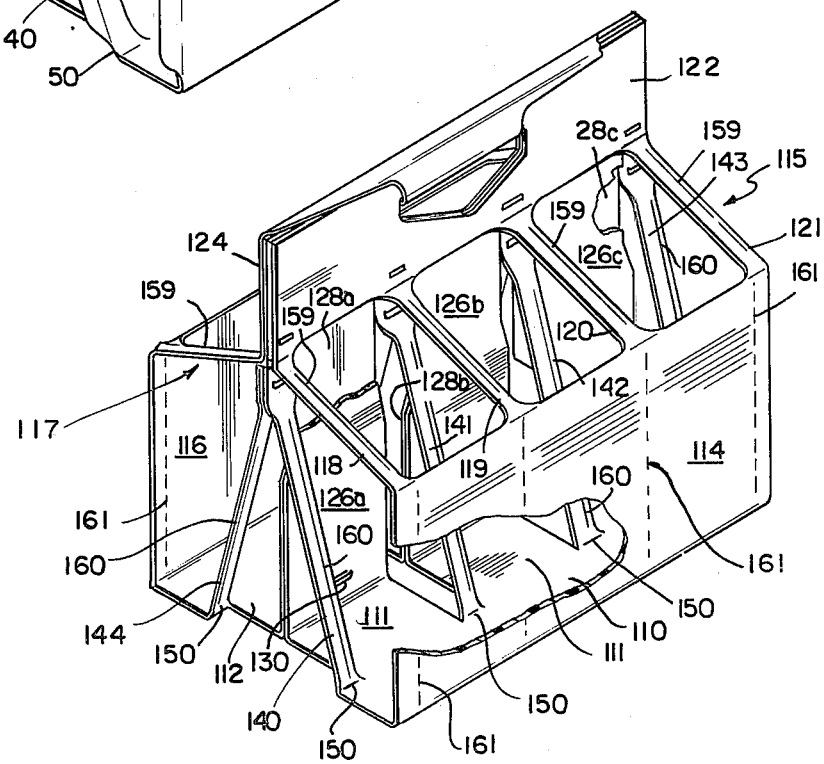
FIG. 2 is a perspective view of a six-bottle carrier in which collapsing involves a similar double-telescopic movement of the handle layers.
Figure 12:
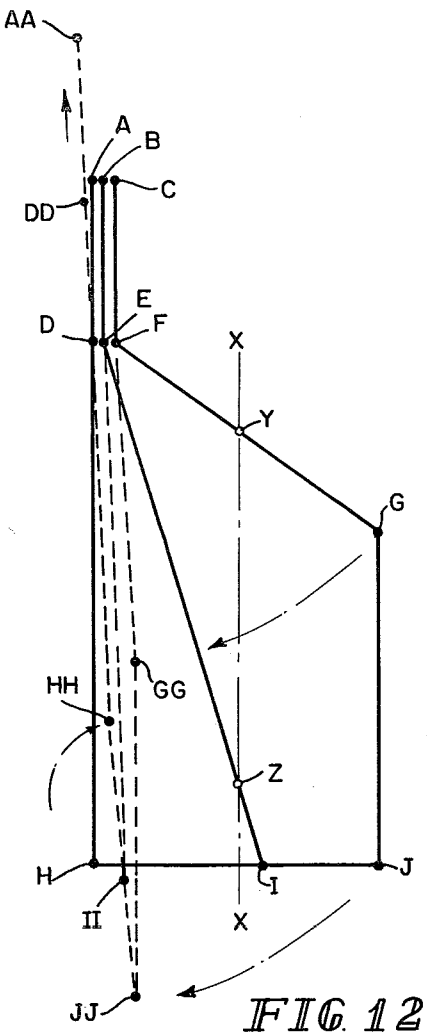
Figure 3:
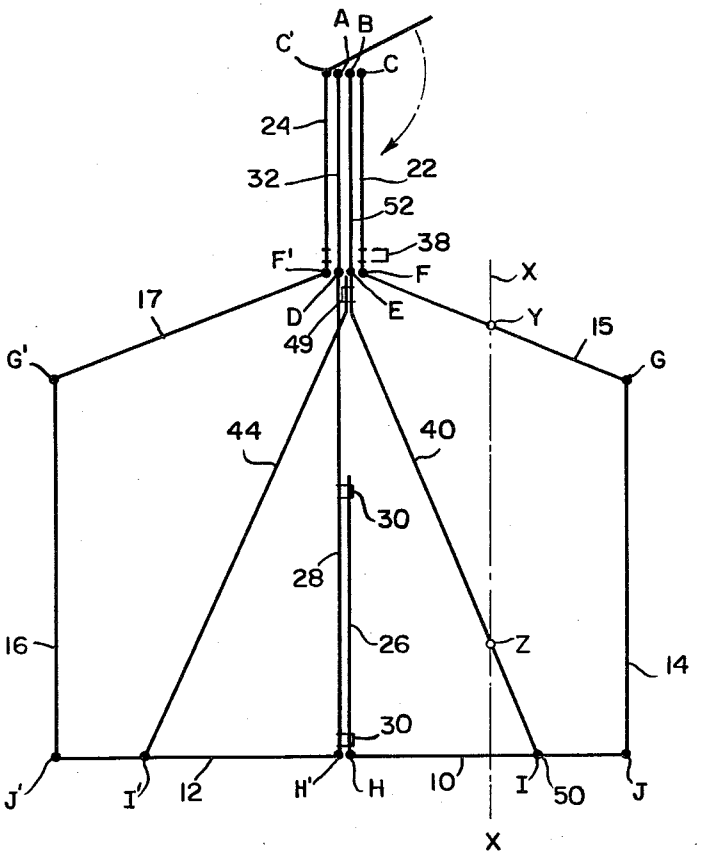
FIG. 3 is a somewhat diagrammatic end elevation of the carrier shown in FIG. 1, in erected condition.
Figure 8:
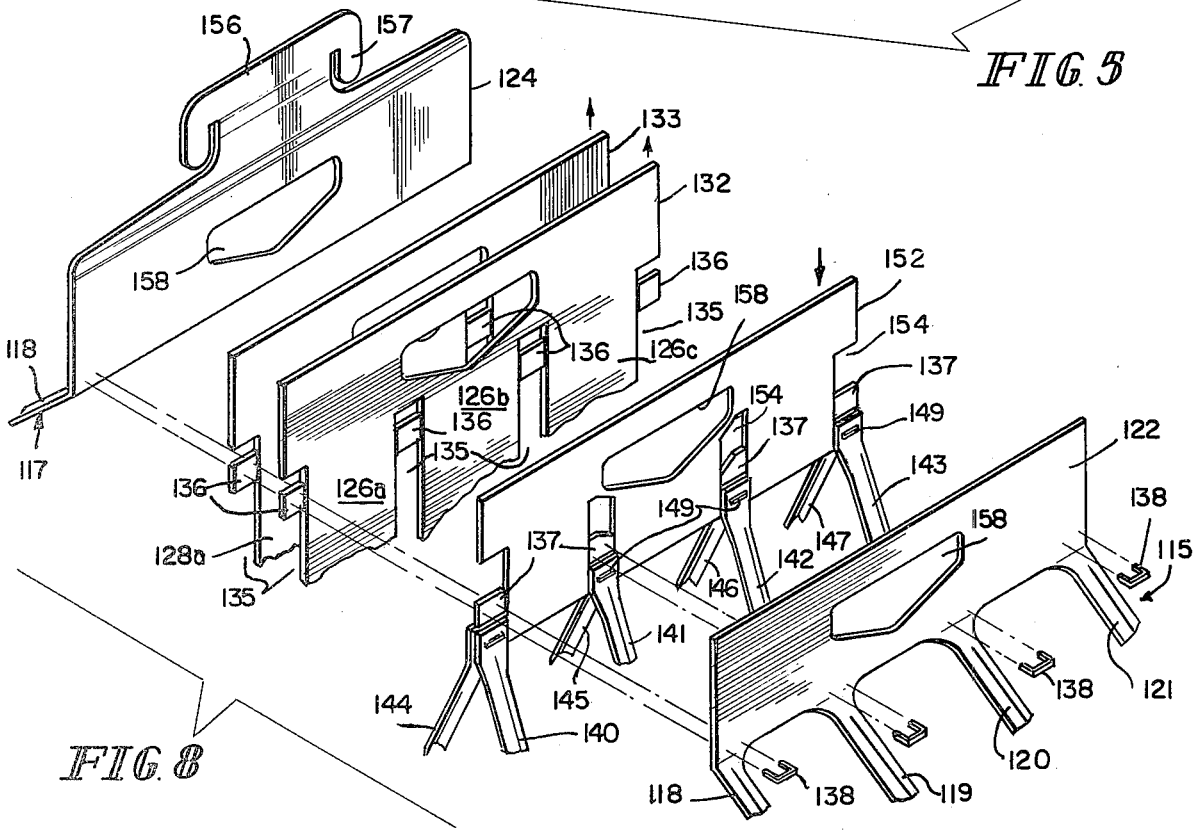
FIG. 8 is an exploded perspective view corresponding to FIG. 5 but showing the six-bottle carrier of FIG. 2.
Figure 9:
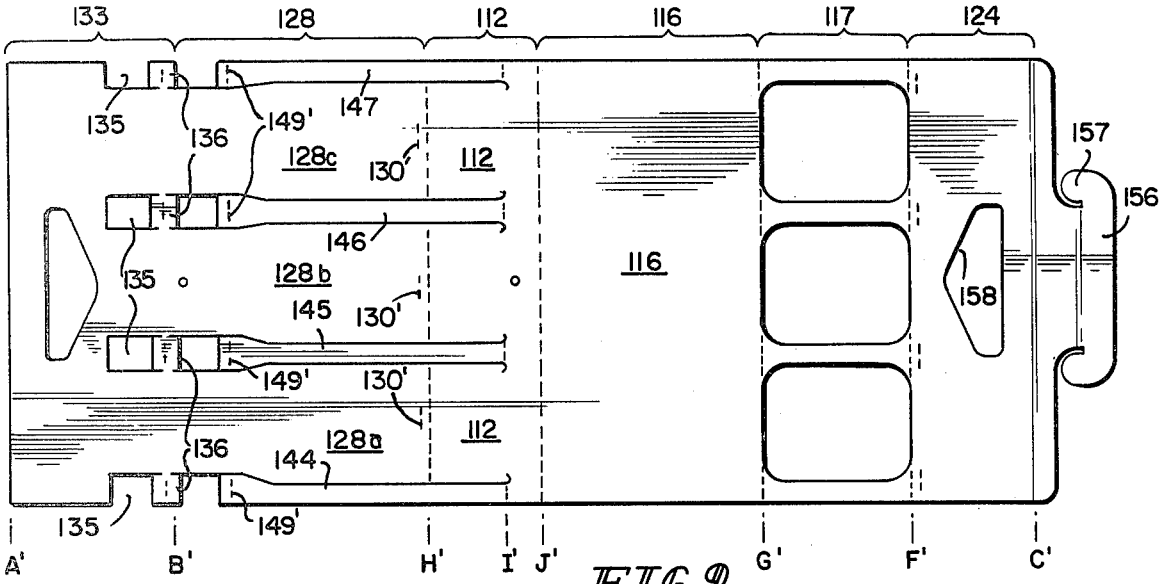
Figure 10:
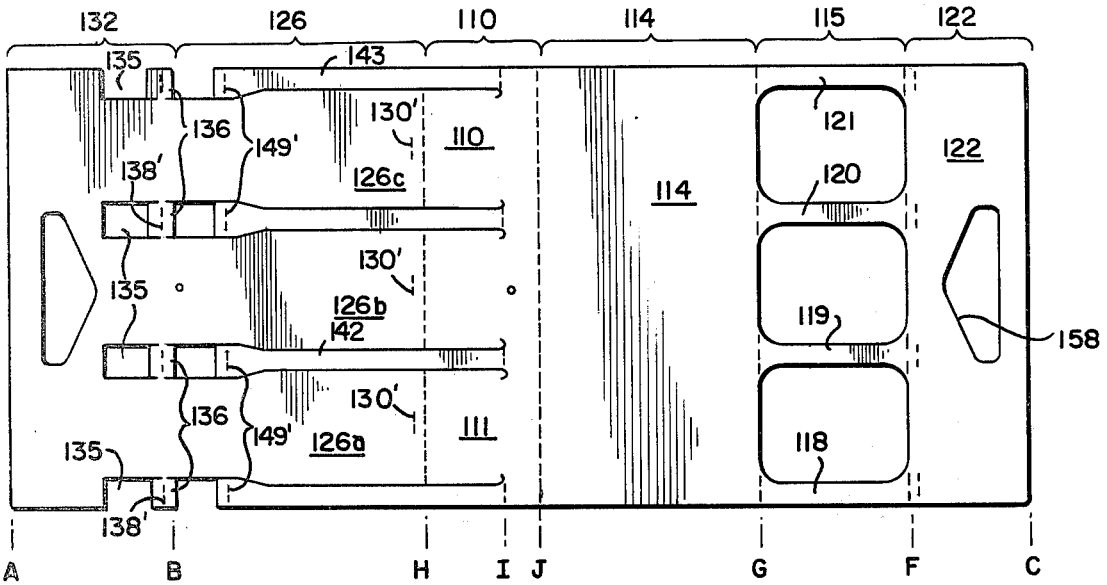
Figure 11:
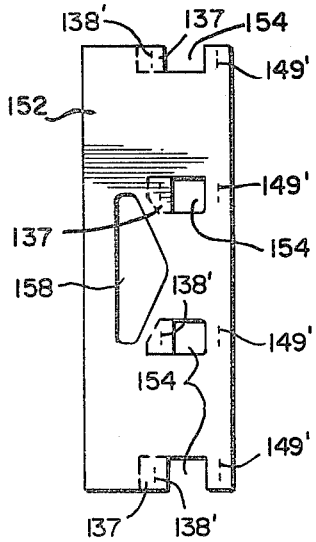
Figure 13:
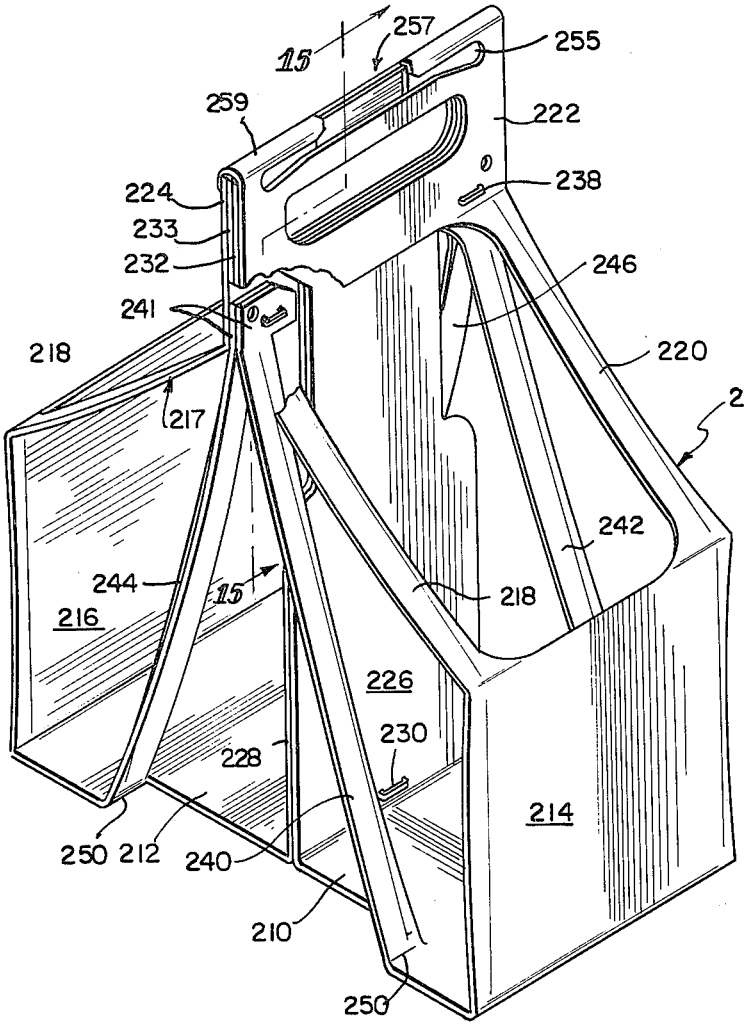
Figure 14:
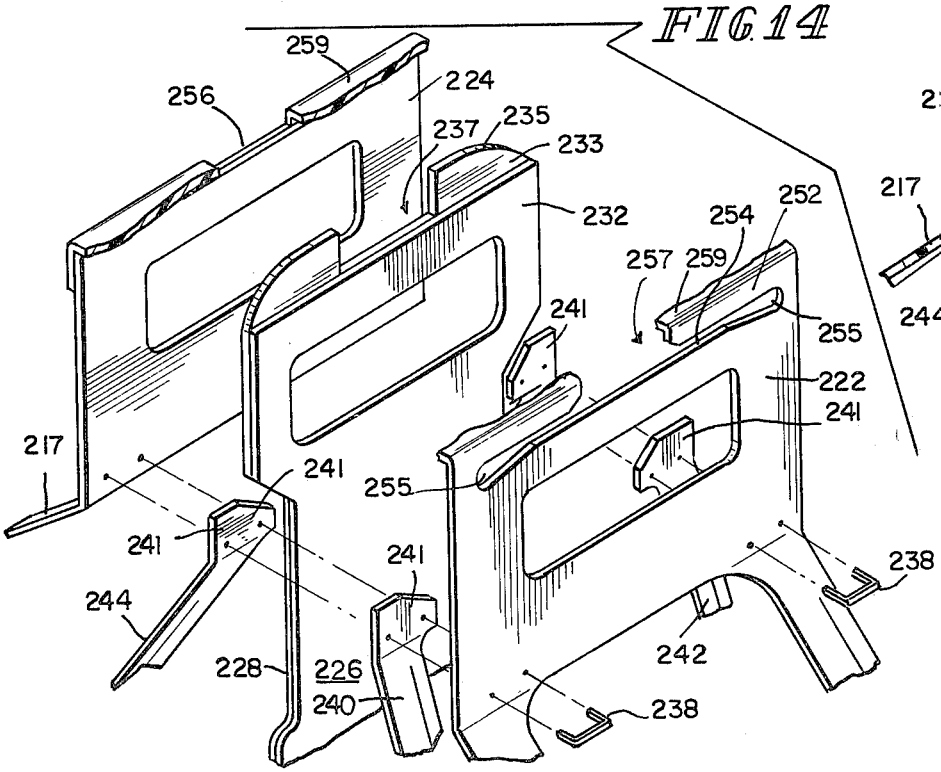
Figure 15:
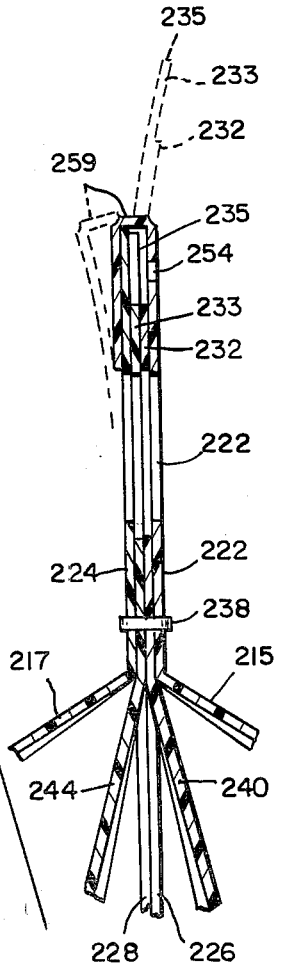
Figure 16:
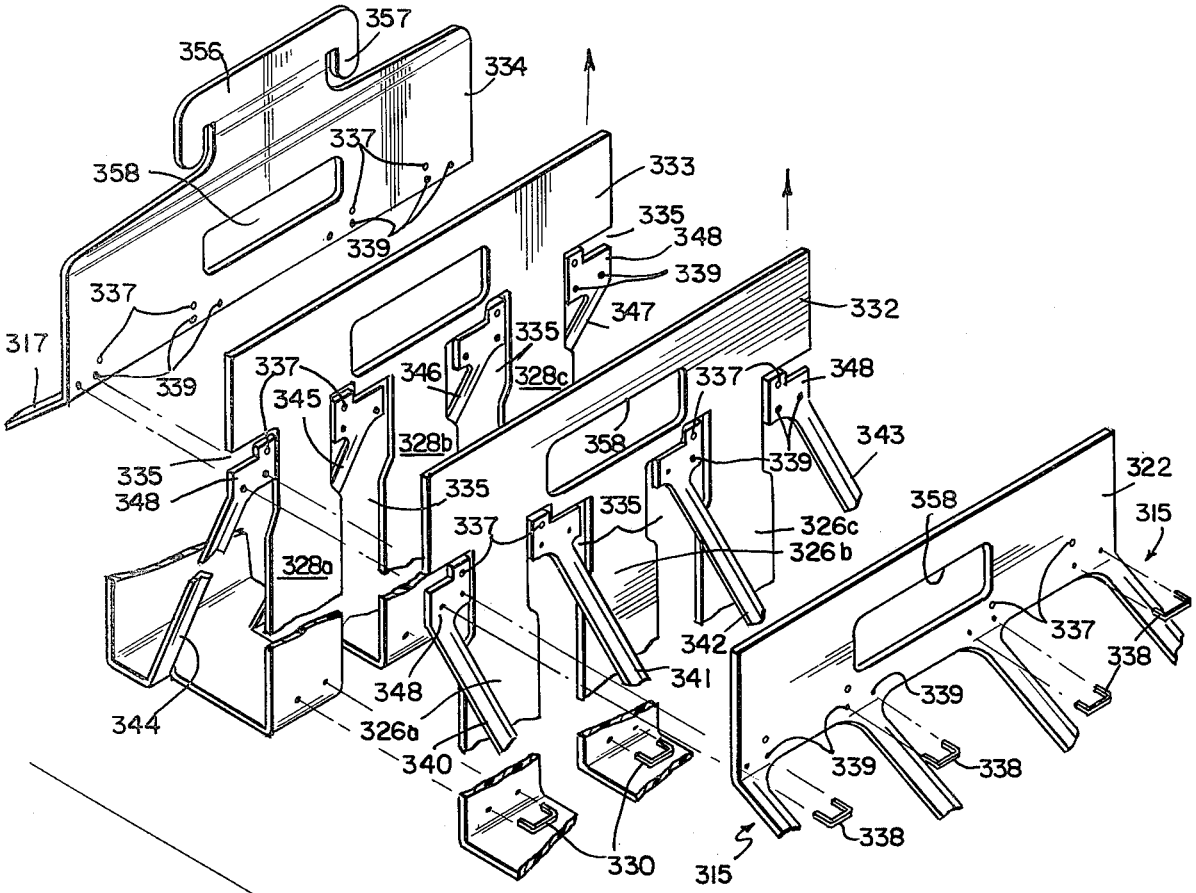
Figure 18:
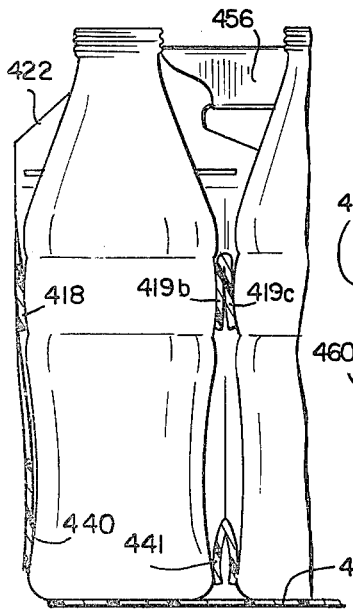
Figure 17:
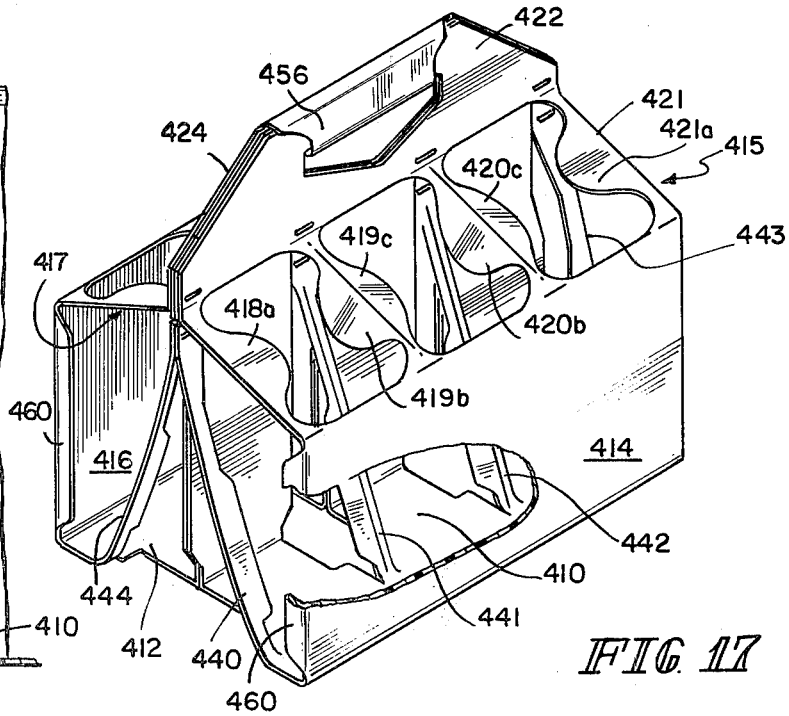

FIGS. 9, 10, and 11 are plan views of the blanks used to form the six-bottle carrier of FIGS. 1 and 8;

FIG. 12 is a geometric diagram illustrating the folding movements of a carrier in which only a single handle layer telescopes relative to other handle structure, in comparative relation with FIG. 3 in which the lift-strut handle layer slides downward and the center panel handle layer slides upward as the carrier is collapsed;

FIG. 13 is a perspective view of a two-bottle carrier which collapses with a single telescopic action as shown in FIG. 12, and which has a handle structure which automatically locks in erected condition;

FIG. 14 is an end exploded perspective view of the handle parts of the carrier of FIG. 13;

FIG. 15 is an end elevation of the assembled handle parts, shown in locked, erected condition;

FIG. 16 is an exploded perspective view of the handle and certain other structure of a six-bottle carrier like the two-bottle carrier of FIGS. 13–15, having only a single telescopic handle layer, and held erect by a handle flap; and FIGS. 17 and 18 are perspective and partial sectional views of a modification of the carrier of FIG. 2, having differently shaped separator strips and struts.

The bottle carrier shown in FIG. 1 is adapted to carry two bottles, such as half-gallon bottles, which are considered to be in two rows with one bottle in each row. It is made from two die-cut blanks, as will be explained below. The carrier has two horizontal bottom panels 10 and 12 to support two bottles, joined at their outer edges to two upright outer face panels 14 and 16. The face panel 14 is joined at the top to a top panel 15 consisting of two spaced strips 18 and 20 at its edges, which extend inward in an upward sloping direction and are connected at their upper ends to an outer handle layer 22. The opposite outer face panel 16 is likewise connected at its top to a top panel 17 consisting of strips 18 and 20 which are connected at their upper ends to an opposite outer handle layer or element 24. The space between the strips 18 and 20 in each top panel constitutes a bottle-receiving opening, defined by such strips. The inward portions of the bottom panels 10 and 12 have marginal panels thereof cut away and their remaining central portions are integrally connected at their inward edges to upright central panels 26 and 28. While in some cases both such central panels may be carried upward into the handle structure, in the carrier shown, the central panel 26 is a shortened panel and is attached by staples 30 to the corresponding portion of the panel 28. The panels 26 and 28 are narrower than the outer face panels 14 and 16 and have a width less than the length of the handle elements 22 and 24, by reason of having marginal edge portions cut away in the carrier blanks, as will appear. The upper end of the center panel 28 extends up into the handle structure, in a plane next adjacent the handle layer 24, and is there connected to a handle layer or element 32. Such handle layer 32 is cut away at its lower outer corners so as to leave open rectangular corner spaces 34 for the reception of two rectangular spacers 36. The two outer handle layers 22 and 24 are connected together by staples 38 which extend through such spacers 36. The central panel 28 lies between the two spacers 36, and its adjoining handle layer 32 lies above such spacers 36, and both the center panel 28 and its handle 32 are free to move vertically upward with respect to the spacers 36 and the outer handle layers 22 and 24.

The carrier also includes four lift struts 40, 42, 44, and 46 which are formed by marginal edge portions of the carrier blanks, cut away from the sides of inward portions of the bottom panels 10 and 12 and from the sides of the center panels 26 and 28. Each lift strut is integrally connected at its lower end to a bottom panel by a hinge line 50, at a position somewhat more than half the distance from the inward edge to the outward edge of that bottom panel, so that the lift strut is connected to the bottom panel in the outer half thereof and of the bottle position thereon, outward of the vertical center plane of a bottle resting on the bottom panel. The lift struts extend upward and inward from the hinge lines 50 across the center plane of the bottle, so as to confine the bottle between them. The two struts 40, 44 and 42, 46 at each end of the carrier are connected together and to a handle layer 52 at their upper ends. Conveniently, the upper ends of the lift struts 44 and 46 are integral with the handle layer 52 and the other struts 40 and 42 are connected thereto by staples 49. The handle layer 52 has notches 54 cut out of its side edges to form slots for the reception of two spacers 37 lying against the spacers 36. The slots extend upward from those spacers 37 a substantial distance so that the handle layer 52 will be free to slide downward relative to those spacers and the outer handle layers 22 and 24 when the carrier is collapsed.

Each of the handle layers has a hand grip opening 58, and one of the outer handle layers 22 and 24, here shown as the handle 24, is connected by two closely-spaced bend lines to a handle flap 56 having ears 57 with downward-extending lobes 59. When the carrier is in erect condition, as shown in FIG. 1, the flap 56 is passed across the top of the other handle layers 32, 52, and 22, and thence downward and back through the handle openings 58 of those layers so as to lock the several handle layers together against relative vertical movement, and thereby lock the carrier in erected condition. The ears 57 secure the flap in a position in which the flap is locked through the openings 58 and the lobes lie against the face of the handle and hold the flap turned up to form a comfortable hand grip surface, as shown in FIG. 1-A. For purposes of stiffening the structural elements of the carrier, such elements are desirably provided with longitudinal crease lines or bend lines which stiffen them against longitudinal bending so that they tend to remain stiff and straight in the erected carrier. For this purpose, in the carrier of FIG. 1, the outer face panels 14 and 16, the top panel edge strips 18 and 20, and the four lift struts 40, 42, 44, and 46 are all provided with edge flanges 60 which are bent under heat and set at angles to the planes of the elements to which they are connected.

The particular location of the bend lines 50 connecting the lower ends of the struts 40–46 to the bottom panels may vary with a number of factors. Their placement at the outer half of the bottom panel provides that the struts will cross the sides of the adjacent bottle or bottles to hold the same in proper bottle position and separate each bottle from adjacent bottles. This is shown in the diagrammatic end elevation of FIG. 3. The strut 40 extends from the bend line 50 at point I upward and inward across the bottle center line X—X at the point z. It will be seen that movement of the point I inward or outward on the bottom panel 10 (HJ) will lower or raise the cross-over point z. The cross-over point z is desirably low on the bottle, and from this point of view the bend lines 50 should be close to the center line X—X of the bottle. On the other hand, by moving the bend lines 50 farther out, a greater width of material is available between the circular bottom of the bottle and the edge of the generally square panel so that the length of such bend lines can be increased to increase the strength of the connection. The location also affects the geometry of the carrier and the manner in which it collapses, as is further discussed below. In the embodiment of FIGS. 1 and 3–7, the distance from the center panel to the bend lines 50 (distance HI in FIG. 3) is about 75% of the length (HJ) of the bottom panel between its inner and outer edges. Such distance is desirably from say 60% to 90% of such length.

The carrier of FIG. 1, when in erected position and locked in such position by engagement of the handle flap 56 through the handle openings 58, forms a relatively rigid and upright carrier in which bottle-receiving openings are well defined so that the carrier is well adapted to receive two large bottles in automatic loading equipment. When in place, the bottles are confined and protected at all four sides, by the handle and center panels at the inner faces, by outer face panels 14 and 16 at the outer faces, and by the top panel strips 18 and 20 at opposite sides of the upper end of the bottle and by the lift struts at opposite sides of the bottom of the bottle. Desirably, the spacing between the top panel edge strips 18 and 20 and between the inner edges of the lift struts 40–42 and 44–46 is somewhat smaller than the overall diameter of the bottles which are to be received in the carrier, so that such elements are yieldingly distorted cross-wise as the bottles are inserted in the carrier. This causes the carrier to support the bottles snugly and firmly and with some resilience, and reduces the space which would otherwise be required for the structural elements at the sides of the bottles. When the bottles are in place, they are securely held and are separated from each other and from bottles in adjacent carriers in a common shipping case.

Figure 5:
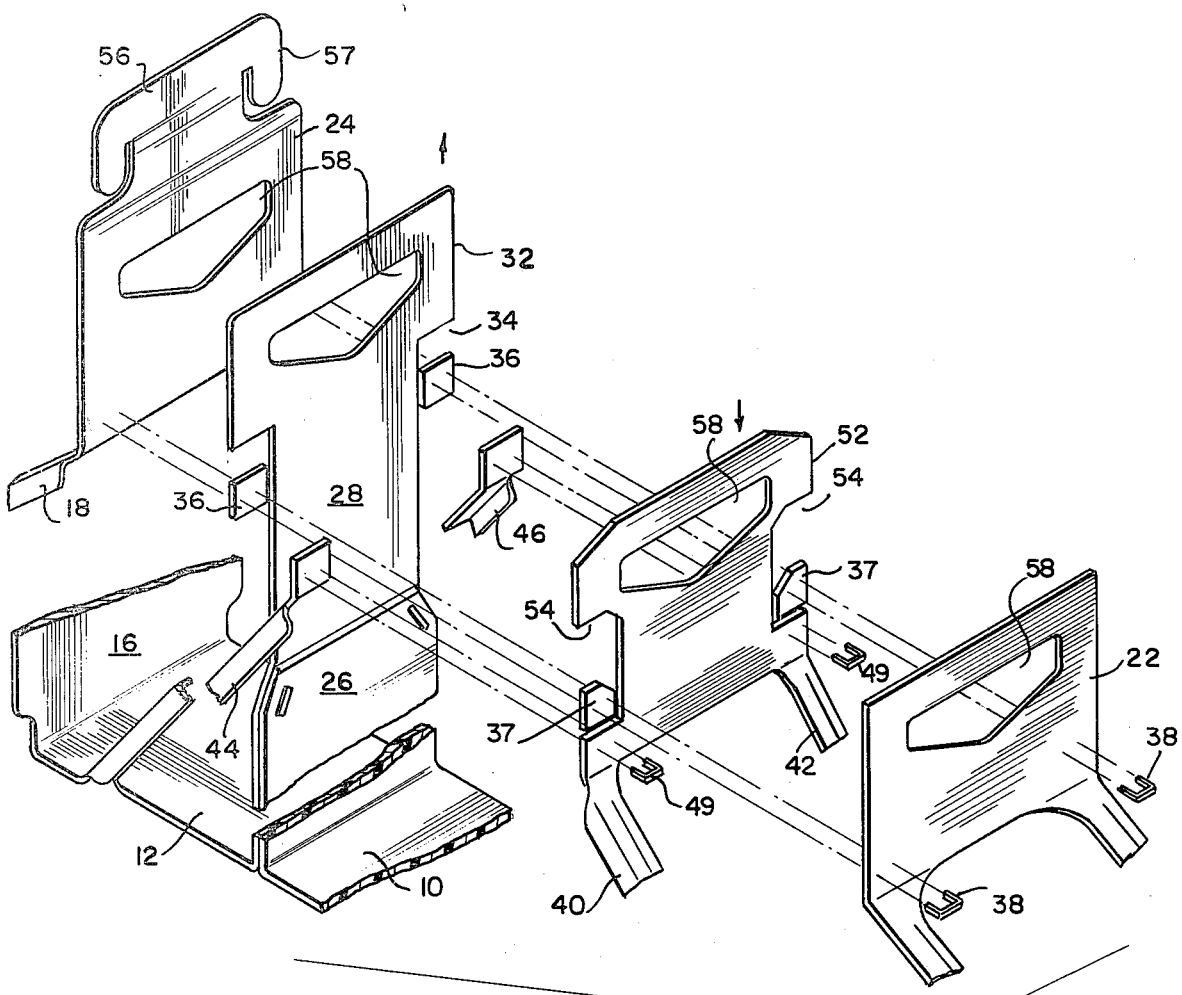
FIG. 5 is an exploded perspective view showing the relationship of the handle parts of the carrier of FIG. 1, and the relative movement of the parts as the carrier is collapsed from erected position (FIG. 3) to collapsed position (FIG. 4)

The relative positions of the handle layers and their freedom of relative movement during collapsing of the carrier is shown in FIG. 5. The outer handle panels 22 and 24 are in registry and fastened to each other by staples 38 which pass through the spacers 36 and 37 in the planes respectively of the handle layers 32 and 52. The staples hold the outer handle layers flat against the spacers so that the connected parts form two guideways in the planes of the two layers of spacers. The lower portion of the handle layer 32 and its connected center panel 28 lie between the spacers 36 and the spacers are at the top of the side slots 34 so that the handle layer 34 and center panel 28 are free to move upward, as shown by the arrow above them.

The upper ends of the lift struts 44, 46 are connected to the upper ends of the struts 40, 42 integral with the handle layer 52. Such layer lies in the plane of the spacers 37 and its side notches extend upwardly so that the handle layer 52 can move downward, as indicated by the arrow above that layer.

Figure 4:
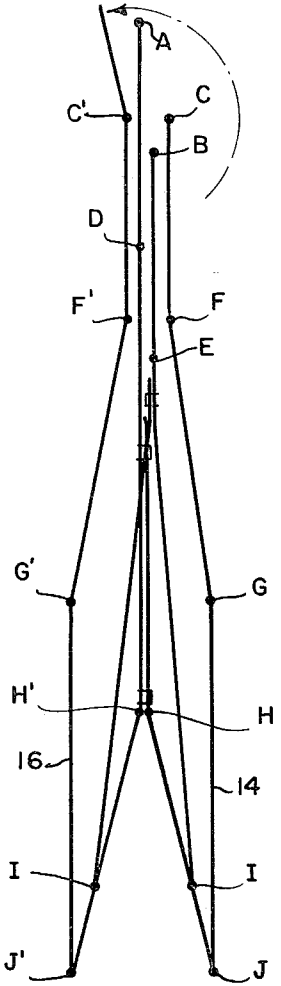
FIG. 4 is a similar end elevation of the same carrier as FIG. 3, with such carrier in collapsed condition.

From the erected position shown in perspective in FIGS. 1 and 5 and in diagrammatic end elevation in FIG. 3, the carrier of FIG. 1 is readily collapsed to a substantially flat condition. The diagram of FIG. 4 shows it approaching such flat condition. In FIGS. 3 and 4, the edge flanges 60 which reinforce and stiffen the several elements of the structure are omitted and the several layers of the handle structure are shown separated, for clarity. For purposes of explanation, the ends of the handle layers and the junction points of the carrier elements are identified by reference letters A to J. It may be assumed that the outer handle layers 22 and 24 (CF and C'F') which are interconnected by the staples 38 remain stationary and that the other parts move relative to them. As the carrier is collapsed, the two top panels 15 and 17 (FG and F'G') swing downward about hinge lines F, F' at the bottom of the outer handle layers 22 and 24. This carries the outer face panels 14 and 16 (GJ and G'J') downward in generally parallel translation, and the bottom panels 10 and 12 (HJ and H'J') swing upward about hinge lines at the lower edges J, J' of such outer face panels. This causes the center panels 26 and 28 (HD and H'D) and their connected handle layer 32 (AD) to slide upward relative to the outer handle layers 22, 24. The geometry is such that as the outer face panels 14 and 16 move downward and the center panels 26 and 28 move upward, the lift struts 40 and 44 (EI and EI') which are connected to the bottom panels at the points 50 (I and I') are drawn downward and this in turn draws the handle layer 52 downward. The parts thus move to collapsed positions as indicated by the nearly collapsed positions shown in FIG. 4.

Figure 6:
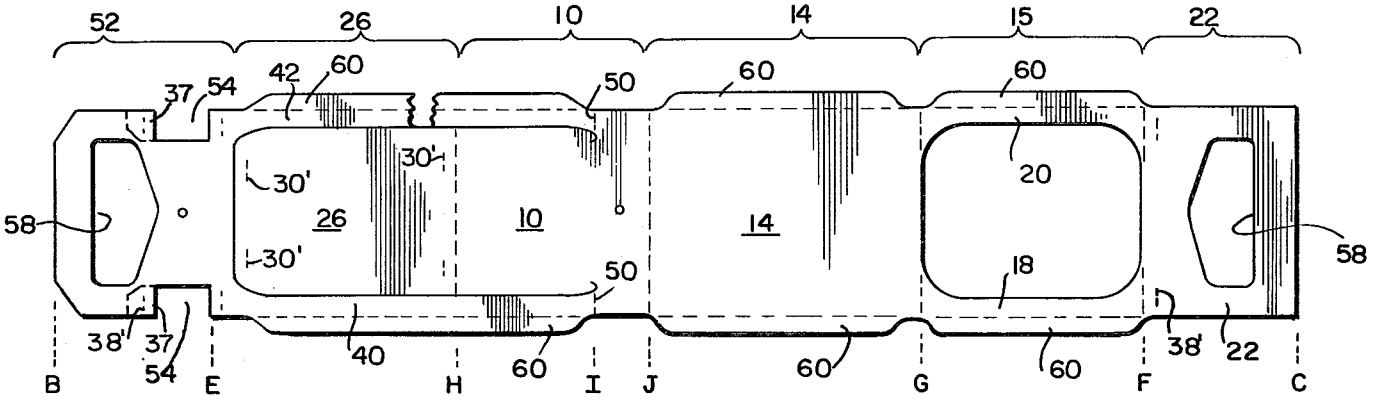
FIGS. 6 and 7 are plan views of the two blanks used for forming the two-bottle carrier of FIGS. 1 and 3–5.
Figure 7:
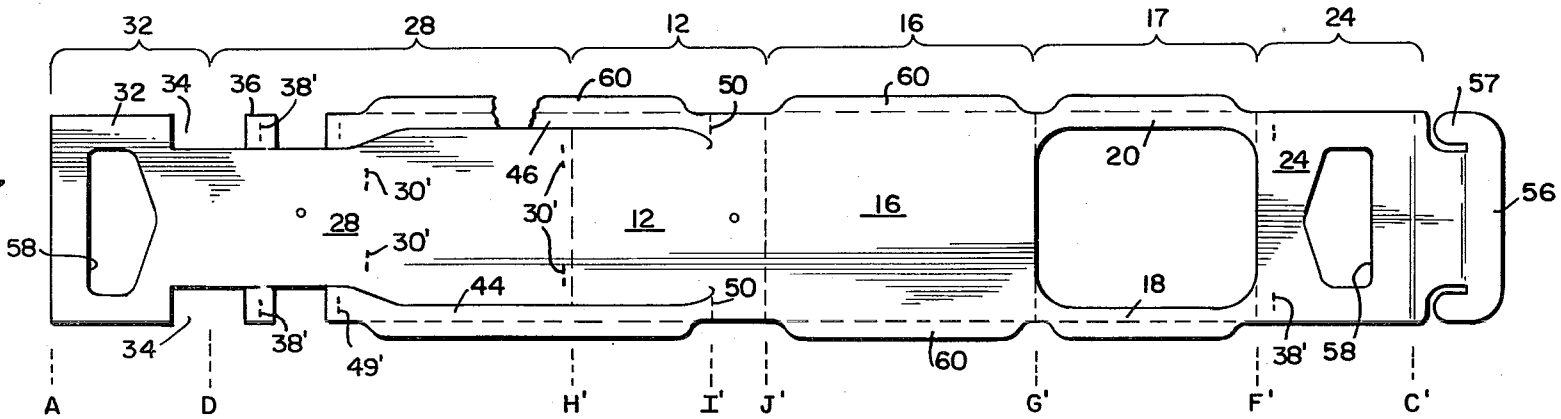

FIGS. 6 and 7 show the two blanks used in making the carrier of FIGS. 1 and 3–5. Such blanks may be die cut from a strip of plastic sheet stock of the same width as the blanks, and it will be seen that there is very little waste. Substantially the only parts of the sheet stock which are removed from the strip stock are the openings in the top panels, the material of handle openings 58, the parts cut out to form the side notches 34 and 54, and the narrow edge portions where flanges 60 are not present. In the blanks of FIGS. 6 and 7, the several panels and other elements of the carrier are designated by the same reference numerals used in the foregoing description, and the junction lines or bend lines between the panels are shown by broken lines which are referenced with the same letters A–J as in FIGS. 3 and 4. It will be seen in FIG. 6 that the shortened center panel 26 is formed of material between the two lift struts 40 and 42, and that such shortened center panel is integrally joined by a bend line H to the bottom panel 10. Such lift struts 40 and 42 are integrally joined to the bottom panel 10 by the bend lines 50 at the position I, and their upper ends are integrally joined to handle layer 52 at the junction line E. The side notches 54 are cut out, but part of the slot material is left in place to form the two spacers 37, and these are left detachably connected to the blank so as to be properly located for assembly. In FIG. 7, cut lines separate the two lift struts 44 and 46 from the inwardly adjacent center panel 28 and a portion of the bottom panel 12, but the lower ends of the struts are left integrally connected at bend lines 50 (at junction line I') to that bottom panel 12. Again, on this blank, the side notches 34 are cut out, but part of the slot material is left in place to form the two spacers 36, and these are left detachably connected to the center panel 28 for assembly in registry with the spacers 37 of FIG. 6. For convenience of illustration, the several edge flanges 60 are left coplanar with the elements to which they are attached, although it will be understood that in commercial manufacture, such edge flanges would be bent to their angular positions under heat before assembly of the two blanks.

In assembly, the blank of FIG. 6 is laid on top of the blank of FIG. 7. This disposes the shortened center panel 26 in registry with the lower portion of the center panel 28, and disposes the free-ended lift struts 44 and 46 beneath and in registry respectively with the lift struts 40 and 42 which are connected at their upper ends to the handle layer 52. With the two blanks in this overlying relation, the staples 30 are applied in the positions 30' to fasten the shortened center panel 26 to the lower portion of the center panel 28, and the staples 49 are applied at points 49' to fasten the free ends of the lift struts 40 and 42 to the ends of the lift struts 44 and 46 and to the handle layer 36. The right end of the overlying blank of FIG. 6 is then bent upward about the junction line J laid on top of the left end of the partially assembled blanks; while the right end of the underlying blank of FIG. 7 is bent downward about the junction line J' and laid under the left end of the partially assembled blanks. This disposes the handle layer 22 on top of the handle layer 52, with the lower corners of such handle 22 in registry with the spacers 37 of FIG. 6. It also disposes the handle layer 24 beneath the handle layer 32 and the upper end of the center panel 28, with its lower corners in underlying registry with the spacers 36 of the blank of FIG. 7, which in turn are in underlying registry with the spacers 37 of the blank of FIG. 6 and with the lower corners of the handle layer 22. The two staples 38 are then applied in the positions 38' to secure the handle layers 22 and 24 to each other with the two layers of spacers 36 between them at their lower corners. Manipulation of the stapled blanks will detach the spacers 36 and 37 from their connection with the two blanks. This completes the assembly of the carrier, and it is ready for storage in flat condition as assembled or for erection for use. It may be erected from collapsed condition (FIG. 4) to erected condition (FIG. 3) by pulling outward on the outer face panels 14 and 16, and pulling downward on the center panels 26 and 28.

The bottle carrier shown in FIGS. 2 and 8–11 is generally similar to that of FIG. 1 and FIGS. 3–7 and is likewise adapted to contain two rows of bottles, but in this case with three bottles in each row instead of one bottle in each row as in FIG. 1. It thus illustrates that the carrier can be made to contain any reasonable number of bottles in each row. The carrier of FIG. 2, like that of FIG. 1, is made from die-cut blanks, as will be more fully explained below. The carrier comprises two horizontal bottom panels 110 and 112, which are connected at their outer edges to two upright outer face panels 114 and 116. The face panel 114 is connected at the top to a top panel 115 consisting of four spaced separator strips, including two end strips 118 and 121 and two intermediate strips 119 and 120. Such strips extend inward in an upward sloping direction and are connected at their upper ends to an outer handle layer 122. The opposite outer face panel 116 is likewise connected at its top to a top panel 117 consisting of four similar separator strips 118–121 which are connected at their upper ends to an opposite handle layer 124.

The inward portions of the bottom panels 110 and 112 have strips thereof cut away in vertical alignment with the separator strips 118–121, and the remaining tongue portions 111 between such cut-away strips are integrally connected at their inner edges to upright central panel sections 126*a*, *b*, and *c*, and 128*a*, *b*, and *c*. The three sections of the central panel 126 extend upward into the handle structure and are there integrally connected to a handle layer 132, while the three sections of the central panel 128 extend upward into the handle structure and are there integrally connected to a separate handle layer 133. Thus in this case, each center panel 126, 128 has its own handle layer 132, 133; whereas in FIG. 1 the two center panels 26 and 28 were connected to a single handle layer 32. Either construction can be used in either carrier.

The strips of material cut away between the inward portions 111 of the bottom panels 110 and 112 in vertical alignment with the top panel separator strips 118–121 are continued in material between the center panel sections 126*a–c* and 128*a–c*. As shown in FIG. 8, the slots left by such strips are extended upward into the handle layers 132 and 133 to form four guideways 135 for the reception of two layers of four spacers 136 for purposes which will appear.

The four strips cut from the slots or guideways 135 in each blank are left integrally connected at their lower ends to the bottom panels 110 and 112 at bend lines 150, and are used to form lift struts 140–147 (FIG. 8). Such struts extend straight upward and inward to positions immediately below the handle layers 122 and 124, where their upper ends are connected, as by staples 149, to the bottom edges of a separate fifth handle layer 152. There are four lift struts 140–143 between the bottom panel 110 and the handle layer 152, and four lift struts 144–147 between the bottom panel 112 and the handle layer 152. As shown in FIGS. 8–10, the handle layer 152 is formed with four slots 154 immediately above the upper ends of those lift struts, and spacers 137 are located in those slots, in positions of registry with the spacers 136 in the handle layers 132 and 133. As shown in FIG. 8, the outer handle layers 122 and 124 are secured together at their lower edges by four staples 138 which pass through the spacers 136 and 137. This leaves guideways in the planes between the outer handle layers 122 and 124, between the spacers 136 and 137 in the planes of the intermediate layers 132, 133, and 152, to permit such intermediate layers to slide vertically in the handle when the carrier is collapsed and erected. The five handle layers each contain a hand grip opening 158, and the handle layer 124 carries a flap 156 having ears 157, adapted to be folded over and through the hand grip openings to lock the handle layers in carrier-erected condition.

As in FIG. 1, several structural elements of the carrier of FIG. 2 are stiffened by being formed with longitudinal crease lines or bend lines. As shown in FIGS. 2 and 8, the four separator strips 118–121 of each upper panel are formed with longitudinal crease lines 159 so that over most of their length they have inverted shallow V configuration in cross section. Similarly, each of the lift struts 140–147 is formed with a longitudinal crease line 160. Also, each of the outer face panels 114 and 116 is formed with four spaced vertical crease lines 161, generally coplanar with the crease lines 159 and 160. These several crease lines stiffen the parts in which they are formed to hold such parts straight and able not only to transmit tension forces but also thrust forces, so that the carrier in erected condition is held in a sharply configured regular shape, with its center and outer panels straight and vertical and with the bottle openings between the separator strips of the top panels held open for the ready reception of bottles loaded therein by automatic loading equipment. The stiffening of the several parts thus serves not only to improve the appearance of the carrier but also to enhance its function in loading and in use as a carrier.

The carrier of FIG. 2 defines openings for the reception of two rows of three bottles each. Each bottle is confined at the top between a pair of separator strips 118–120 of a top panel of the carrier, and confined at the bottom between the lower portions of a pair of the lift struts 140–147. The bend lines 150 at which such struts are connected to the bottom panels are spaced outward from the center panels 126, 128 by somewhat more than half the diameter of the bottles and somewhat more than half the distance from such center panels to the outer face panels 114 and 116. As in FIG. 3, the struts extend upward and inward from the lines 150 (points I, I') across the center lines of the bottles at the points z, and thence to their connection at the top (point E) with the handle layer 152. By locating the connections 150 outward of the center lines of the bottles, such connection lines 150 can be located in reasonably wide areas between the circular bottom of the bottle and the underlying generally rectangular bottle-supporting portion of a bottom panel 110, 112. The bend lines 150 which form such connections can hence be longer and stronger. They are also spaced a farther distance from the point at which the lift struts cross the center lines of the bottle, and this in turn permits the lift struts to fold in cross section about their crease lines so as to take up less space between the bottles than would otherwise be required. Similarly, the separator struts 118–120 in the top panels of the carrier are adapted to fold transversely about their crease lines so as to reduce the width which they occupy between the bottles. In each case, the transverse bending is resiliently opposed by the inherent resiliance of the plastics material from which the parts are made, so that the separating elements provide resiliently yieldable separators and exert resilient pressure against the sides of the bottles.

The carrier provides protection for each bottle on all four sides. Thus, each bottle is protected at its inner face by a section of a center panel 126 or 128, at its outer face by an outer face panel 114 or 116, and at its opposite sides by two of the separator strips 118–121 at the top and by two of the lift struts 140–147 at the bottom.

From the erected position shown in FIG. 2, the six-bottle carrier is readily collapsed to a substantially flat condition, in generally the same manner as described above for the carrier of FIG. 1 with reference to FIGS. 3 and 4. The relative positions of the several handle layers of the six-bottle carrier of FIG. 2 are shown in FIG. 8. In the positions shown for the erected condition of the carrier, the several handle layers 122, 152, 132, 133, and 124 are all in substantial registry, and can be locked in registry by folding the handle flap 158 across the top of the assembled handle layers and thence back through the registering hand grip openings 158. When that handle flap is released, the handle layer 152 connected to the upper ends of the lift struts 140–147 is free to slide downward relative to the outer layers 122 and 124, since slots 154 in the layer 152 extend a substantial distance above the positions of the spacers 137. Such downward movement is indicated by an arrow on that handle layer 152. Also, the handle layers 132 and 133 at the top of the center panel sections **126*a–c* and 128*a–c* are free to slide upward, as indicated by the arrows above those layers, since the slots 135 extend downward below the spacers 136 fixed to the outer panels 122 and 124. Such two handle layers 132 and 133 together correspond to the single handle layer 32 of FIGS. 3 and 4, and with this correspondence, the collapsing occurs in substantially the same way as shown in FIGS. 3 and 4** and described in connection therewith.

As the carrier is collapsed, the top panels 115 and 117 swing downward about junction lines F, F', and the outer face panels 114 and 116 move downward in generally parallel translation. The bottom panels 110 and 112 swing upward about the junction lines J, J', which causes the center panel handle layers 132 and 133 to slide upward in the guideways defined by the spacers 136. The geometry is such that as the outer face panels 114 and 116 move downward and the center panels 126 and 128 move upward, the lift struts 140–147 connected to the bottom panels at the bend lines 150 are drawn downward, and pull the handle layer 152 downward in the guideways between the spacers 137.

FIGS. 9, 10, and 11 show the three blanks used in making the six-bottle carrier of FIGS. 1 and 8. Such blanks may be die-cut from a strip of plastic sheet stock of the same width as the blanks, with very little waste, substantially the only stock removed being that from the bottle-receiving openings in the top panels and from the handle openings 158. In the blanks, the several elements of the carrier of FIGS. 2 and 8 are designated by the same reference numerals as in those Figs. (with staple locations primed), and the junction lines between the elements are referenced by the same letters as in FIGS. 3 and 4. The center panel sections 126 *a, b,* and *c* and 128 *a, b,* and *c* are formed of material between the lift struts 144–147, and the three sections of each center panel are integral both with the adjoining bottom panel 110 or 112 at the junction line H, H' and with the adjoining handle layer 132 or 133 at a junction line B, B'. The lift struts 144–147 are integral with the adjoining bottom panel 110 or 112 at the junction line I, I', but are free at their upper ends. The slots 135 are cut out in both main blanks of FIGS. 9 and 10; but parts of the material in the slots are used to form the spacers 136, and these are detachably connected to the blanks for location in assembly. Similarly, in the blank of FIG. 11, the slots 154 are cut, but parts of the material in the slots is used to form the spacers 137 and left detachably connected to the blank to position them for assembly. For convenience of illustration, the blanks are shown flat, but it will be understood that in commercial manufacture, the crease lines would be formed under heat before assembly of the blanks.

In assembling the blanks to form the carrier of FIGS. 2 and 8, the blank of FIG. 10 is laid on top of the blank of FIG. 9, and the blank of FIG. 11 is laid on top of the other two, with the spacers 136 and 137 in stacked registry. The bottom edge of the blank of FIG. 11 is interleaved between the free ends of the struts, on top of the struts 144–147 and below the struts 140–143. The sections a, b, and c of the two center panels 126 and 128 will also be in registry. With the blanks in this relationship, the staples 130 are applied to fasten the three sections of the center panel 126 to the corresponding sections of the center panel 128, and the staples 149 are applied to fasten the free ends of the lift struts 140–143 to the upper ends of the lift struts 144–147 and to the intervening blank which forms handle layer 152. The right end of the blank of FIG. 9 is then bent on the junction line J' and folded under the partially assembled blanks; and the right end of the blank of FIG. 10 is bent on the transverse junction line J of FIG. 10 and folded over the partially assembled blanks. This disposes the handle layer 124 beneath the handle layers 133 and 132, with its lower corners in registry with the registering spacers 136 and 137. It also disposes the handle layer 122 on top of the handle layer 152, with its lower corners overlying the registering spacers 136 and 137. The four staples 138 are then applied through the handle layers 122 and 124 and the intervening three layers of spacers 136 and 137, to secure those parts together. This completes the assembly. Subsequent manipulation of the stapled blanks will detach the spacers 136 and 137 from their connection with the three blanks, and the assembled carrier is then ready to be erected. For erection, it is only necessary to swing the bottom panels 110 and 112 outward from their face-to-face position (as in FIG. 4) to their coplanar position (as in FIGS. 2 and 3). This is easily accomplished by spreading from each other the bottom folded edges of the assembly (at the junction lines J and J'), resting such edges on a supporting surface, and forcing the lower ends of the center panels 126, 128 downward against such surface.

The sequence of assembly just described will indicate the simplicity with which assembly can be done. Other assembly sequences and relationships of the several elements of the carrier can be used to suit the convenience and wishes of the manufacturer in commercial operations.

The geometric diagram of FIG. 12 elucidates the relationships and collapsing movements of the parts of a modified carrier having a different geometry from that shown in FIGS. 3 and 4 for both the two-bottle carrier of FIGS. 1 and 3–5 and the six-bottle carrier of FIGS. 2 and 8–11. For convenience, such diagram corresponds to the end elevation of only one-half of each of such carriers, and thus corresponds to the right half of FIG. 3. For comparative reference, the junction points between the carrier elements are identified by the same letters A–J as in FIGS. 3 and 4. Thus, the upper ends of the three handle layers are labelled A, B, C, their lower ends labelled D, E, F, etc. The parts of the erected carrier are represented by full lines in FIG. 12, and the center line of the bottle is represented by the line X–X. From such erected position, the lettered connection points move as indicated by the arrow lines to positions indicated by the same letters doubled. Thus, as the carrier is collapsed, the point G of connection between the outer side panel and the top panel swings down about the point F as a center to the point GG; the point J moves to JJ, etc.

In the geometric configuration of the right half of FIG. 3, representing the carriers of FIGS. 1 and 2, the distance FG plus the distance GJ is greater than the distance EI plus the distance IJ, so that as the quadrilateral F-G-J-I-E collapses during carrier collapsing, the points E and F must move relative to each other, and there must be relative movement between the handle layers CF and BE. As shown, the handle layer BE is pulled downward by the movement of the diagonal strut EI, a distance sufficient to accommodate the length difference of the quadrilateral sides, as indicated by relative positions of the same parts and points in FIG. 4. Also, in this geometric arrangement, the length FG plus the length GJ is less than the center leg length DH plus the bottom panel length HJ. Accordingly, when these pairs of lengths are straightened during the collapsing movement, the point D and the line AD representing the inner handle layer must move upward relative to the handle layer CF, and as indicated in FIG. 4. Thus, the geometry of FIGS. 3 and 4 requires movement of both of two layers of the handle, one (AD) upward, and the other (BE) downward.

In the erect condition of the carrier represented by the full line diagram in FIG. 3, the line FG representing the top panel of the carrier crosses the center line of the bottle at the point Y near the top of the bottle. Similarly, the line EI representing a diagonal lift strut crosses the center line of the bottle at the point Z, near the bottom of the bottle but spaced somewhat upward from the bottom supporting surface represented by the line HJ. The height of the crossing point Z depends on the position of the point I at which the strut line EI is connected to the bottom line HJ, and the location of that point affects and is affected by the geometry of the carrier.

In a carrier having a geometric configuration represented by the diagram of FIGS. 3 and 4, as has been seen, the geometric relationship of the parts is such that two of the handle layers must move relative to the third, and must move in opposite directions. It is possible, however, by using the geometric configuration of FIG. 12, to provide for movement of only one handle layer while the others remain stationary.

In the geometric configuration of FIG. 12, the combined length of the lines FG plus GJ is made equal to the combined length of the lines EI and IJ. Accordingly, when the quadrilateral formed by those four lines is collapsed, the end points E and F undergo no relative movement, and the line BE representing the strut-connected handle layer need not move relative to the line CF representing the outer handle layer. In the movements of the diagram representing collapsing movement of the carrier, the line FG swings about the point F as a center, to carry point G to GG. The vertical line GJ moves parallel to itself to the position GG-JJ. The straightened lengths of the opposite combined sides of the quadrilateral are the same, and the points E and F remain stationary. The collapsing movement causes the line HJ representing the bottom of the carrier to swing upward about the point J to the position HH-JJ. This involves vertical movement of the point H, and consequent vertical movement of the line DH representing the central panel and the line AD representing the handle layer connected thereto.

Both of the two configurations represented by the diagrams of FIGS. 3 and 12 have certain advantages and are deemed to come within the scope of the present invention in its broader aspects, but for many applications, the configuration of FIG. 3 is deemed most desirable. In the configuration providing single handle layer movement as in FIG. 12, it is necessary to move the point I farther from the point J than in the configuration of FIG. 3. This moves downward the point Z at which the strut line EI crosses the center line X—X of the bottle and while this per se is usually acceptable, it also moves the point I closer to the center line X—X. At such closer position, there is less width on the surface of the bottom panel between the circular bottle area and the border of the circumscribed rectangle defined by the bottom panel edges, and hence there is less width for connecting the strut to that bottom panel. Further, the configuration of FIG. 12 requires a steeper inclination of the line FG representing the top panel of the carrier, and while the one-layer movement permits the handle to be shorter in vertical dimension, nevertheless, the net result is to move downward the point Y at which the line FG crosses the center line of the bottle, and hence to move downward on the bottle the point at which the top panel supports the sides of the bottle. The steeper inclination of the top panel of the carrier is also less advantageous from the point of view of inserting bottles in the carrier, especially with automatic loading equipment. In comparison, in the configuration of FIG. 3, the point Z at which the strut line EI crosses the center line of the bottle is higher up on the bottle but still close enough to the bottom to provide adequate support for the bottom end of the bottle. However, the point I is spaced farther from the center line of the bottle at a position where there is more bottom panel surface available for connecting the strut to that bottom panel. The double telescoping of handle layers in the configuration of FIG. 3 requires a somewhat greater vertical height for the handle, but this is not excessive, and any disadvantages are largely offset by the ability to raise the point G representing the top of the outer face panel and thus to increase the height of the outer face panel a substantial amount over the height available in the configuration of FIG. 12. This is not only advantageous for supporting and protecting the bottle, but is highly desirable from an asthetic and promotional point of view in that it provides a larger display space on the surface of the outer face panel for printing identifying and promotional indicia and decoration.

A still different and third geometrical relationship and method of collapsing is possible with a structure of the general configuration of FIG. 12. Thus, it is possible to make the length FG plus GJ equal to the length DH plus HJ, so that the quadrilateral having sides equal to those lengths will collapse without relative movement of the points D and F. In such case, lift strut line EI will be pulled down as the bottom panel length HJ swings down about the point H, and this will represent a carrier in which the only handle layer movement during collapsing is movement of the layer represented by the line BE. While this is a possible alternative, it requires the quadrilateral F-G-J-H-D to be a parallelogram and requires the top panel line FG to be horizontal, and this is considered less desirable than the sloping top panel lines FG in FIGS. 3 and 12.

The two-bottle carrier shown in FIGS. 13–15 collapses with the sliding of only a single handle layer, in accordance with the geometric diagram of FIG. 12. It also has a different handle locking means. Such carrier comprises two bottom panels 210 and 212, joined by hinge lines at their outer edges to vertical outer face panels 214 and 216. The upper ends of the outer face panels are connected at hinge lines to top panels 215 and 217 formed by spaced edge strips 218 and 220. Such strips slope inward and upward and at their upper edges are connected at hinge lines to outer handle layers 222 and 224.

The inner edges of the bottom panels 210 and 212 are integrally connected at hinge lines to center panels 226 and 228 which extend upward toward the handle structure and at an intermediate level are cut away at the sides to leave narrowed portions which are connected to intermediate handle layers 232 and 233. The handle structure will be described in more detail below.

Edge portions of the inward ends of the bottom layers 210 and 212 and of the center panels 226 and 228 are cut away to form lift struts 240, 242, 244, and 246. These are connected at their bottom ends by hinge lines 250 to the bottom panels, and extend upward and inward to the handle structure where they are provided with enlarged head portions 241 which are disposed between the lower corners of the outer handle layers 222 and 224. In final assembly, such lower corners and the head portions of the lift struts are secured together by staples 238. The two center panels 226 and 228 lie in face-to-face relationship, and are secured together at the bottom by one or more staples 230.

The handle structure of this embodiment is arranged to cause the several handle layers to be latched together automatically when the carrier is erected. Each of the handle layers is provided with a hand grip opening 258 in positions which come into alignment when the carrier is erected. The upper edge of the outer handle layer 222 is provided with a top flap 252 which in the assembled relationship of the carrier is bent on two spaced bend lines and secured against the outer face of the opposite handle layer 224. Near the upper end of the handle, the handle layer 222 and the flap 256 are cut out to form a T-shaped opening 254 which extends transversely across the upper portion of the handle layer 222, and has enlargements 255 at its ends. At the center of the handle, the opening 255 extends upward and over across the top of the handle structure. The arrangement thus provides a central slot 257 at the middle of the top of the handle structure, with side extensions 255 in opposite directions in the outer handle layer 222. This leaves bent-over keeper portions 259 of the flap 256 which extends from the outer handle layer 222 across the top of the handle structure and thence downward on the back side of the opposite outer handle layer 224. The upper ends of the intermediate handle layers 232 and 233, connected to the center panels of the carrier, are formed to latch beneath these keeper portions 259 of the handle when the carrier is erected. To this end, the upper edge of the handle layer 232 is cut away to leave the adjacent handle layer 233 projecting upwardly beside it. The upper edge 235 of that handle layer 233 is rounded at its shoulders and provided with a central notch 237 which registers with the notch 257 of the handle structure. When the carrier is in erected condition, the several layers of the handle are in the relation shown in full lines in FIG. 15. The outer handle layers 222 and 224 lie in parallel spaced position with their lower corners secured by the staples 238 to each other and to the intervening head portions 241 of the lift struts 240, 242, 244, 246. The narrowed upper portions of the center panels 226 and 228 extend upward between the outer handle layers 222 and 224 and between the strut head portions 241 at the opposite outer corners of those layers 222 and 224. The handle layer 233 lies with its upper rounded edge 235 trapped below the bent-over keeper portions 259 of the flap 256. The handle layer 232 connected to the center panel 226 lies between the latched handle layer 233 and the outer handle layer 222 and acts as a spacer tending to hold the upper edge of the adjacent layer 233 in engagement with the keeper portions 259.

To collapse the carrier, the upper edge of the outer handle layer 224 and its attached edge portion of the flap 256 are grasped through the slot 257 of the handle structure and the slot 237 of the intermediate handle layer 233 and are deflected, to the left in FIG. 15. The two center panels 226 and 228 may be forced downward slightly to facilitate this action. The deflection of the upper portion of the handle structure carries the keeper portions 259 of the flap out of alignment at the center with the upper edge 235 of the intermediate handle layer 233 and brings the center portion of the slot 255 into alignment with that rounded upper edge 235, so that the handle layers 232 and 233 can slide upward through the slot 254 to the dotted line position shown in FIG. 15. This allows the center panels 226 and 228 to move upward relative to the outer panels, and such movement causes the carrier to collapse in the manner described in connection with FIG. 12. When it is desired to again erect the carrier, it is only necessary to pull downward on the combined center panels 226 and 228 in relation to the handle structure 222–224. This thrusts the inner edges of the bottom panels downward, and hence swings them outward toward erected position. The upper end of the combined center panels 226 and 228 and their handle layers 232 and 233 slide downward through the slot 254 until the upper edge of the layer 233 passes the bent-over keeper portions 259 of the flap 256. Such upper edge then snaps through the slot to the latched position shown in FIG. 15, and the carrier is then automatically locked in erected position.

Various other means may be used to secure the handle layers of this embodiment in erected condition. Such means may include, specifically, the arrangement shown in FIGS. 1 and 5, in which one of the outer handle layers carries a flap 56 with ears 57 which is folded through the handle grip openings so that its base portion overlies the upper edges of the several handle layers and its head portion extends through the hand grip openings and underlies the upper bar portions of those layers.

The geometrical arrangement of FIG. 12 and the embodiments shown in FIGS. 13–15 for a two-bottle carrier may also be used in a six-bottle carrier. The lower portion of such a six-bottle carrier may be generally like that of FIG. 2, except, of course, that the different geometric relation will give it an end elevation like that of the two-bottle carrier of FIGS. 13–15. The structural difference will be largely in the handle structure, and this is shown in exploded perspective in FIG. 16. The handle structure includes two outer handle layers 322 and 324, each having a hand grip opening 358; and the layer 324 is provided with a locking flap 356 having ears 357 as in the modification of FIGS. 2 and 8. Those outer handle layers are connected at their bottom edges to two top panels 315 and 317 defined by four separator strips as in FIGS. 2 and 8. The carrier has two center panels 326 and 328, each composed of three spaced sections a, b, and c, and the several sections of each panel are connected to those of the other panel by staples 330. The three sections of the center panel 326 are connected at their top ends to an intermediate handle layer 332, and the sections of the center panel 328 are connected at their top ends to a separate handle layer 333. The handle layers 332 and 333 have handle grip openings 358 and are each cut out in areas between the sections a, b, and c to form clearance slots 335 for the upper edges of two sets of four lift struts 340–343 and 344–347.

The lift struts are formed of material from the slots 335. Their upper ends have head portions 348 which are fastened together and between the lower edges of the outer handle layers 322 and 324, by staples 338 passing through openings 339 in those elements. The head portions of the lift struts and the lower portions of the outer handle layers 322 and 324 are also provided with locator holes 337 adapted to be received over guide pins in assembling the parts so as to locate the parts in proper alignment for reception of the staples 338. The head portions 348 of the struts serve as spacers to define guideways in their planes in which the narrowed upper ends of the center panel sections can move vertically when the carrier is collapsed.

The relative position of the parts shown in FIG. 16 represent the relationship existing in the erected condition of the carrier, and the several handle layers 322, 332, 333, and 324 are held in this relationship by folding the handle flap 356 over the top of the handle assembly and thence back through the handle grip openings 358 in the several layers of that structure, as in the modifications of FIGS. 1–11. When the modification of FIG. 16 is to be collapsed, the handle flap 356 is removed from the handle grip openings 358, and the lower walls and struts of the carrier are collapsed to a flat position in the manner represented in the geometric diagram of FIG. 12. This is accompanied by upward movement of the connected center panels 326 and 328 relative to the outer handle layers 322 and 324 and the head portions of the lift struts 340–347. Such upward movement is indicated by the arrows above the handle layers 332 and 333 in FIG. 16. The modification of FIG. 16 thus collapses with the movement of only the center panels, and the upper ends of the lift struts 340–347 remain without movement relative to the outer handle layers.

The modified six-bottle carrier of FIGS. 17 and 18 is like that of FIG. 2, with its parts identified by reference numbers in the 400-series corresponding to the 100-series numbers used on corresponding parts in FIG. 2. It differs from that of FIG. 2 in the shape of its top panel strips 418–421 and its lift struts 440–447, and in the shape of its handle structure. Such modified carrier has bottom panels 410 and 412, center panels 426 and 428, outer face panels 414 and 416, all like the corresponding parts of the carrier of FIGS. 2 and 8. Its handle structure is modified in appearance by cutting away on an angle the upper corners of its several layers, e.g., its outer layers 422 and 424, and narrowing the base of the handle flap 456. Also, ends of its outer face panel are stiffened by the use of in-turned flanges 460, like the flanges 60 of FIG. 1.

The top panels 415 and 417 are each formed of four spaced strips 418–421. The end strips 418 and 421 are narrowed at their ends and widened at their mid sections to form inward extending flaps 418 *a* and 421 *a*. Similarly, the intermediate strips are narrowed at their ends and widened at their mid sections to form lateral flaps 419 *b, c* and 420 *b, c;* and the strips are desirably formed with longitudinal crease lines 459 to stiffen them and give the flaps a downward slope. When bottles are loaded, the end strips 418 and 421 twist downward to dispose their flaps a substantially flat against the side face of the bottle as indicated in FIG. 18; and the intermediate strips have their flaps b and c folded downward toward each other so that they also lie against the faces of the adjacent bottles.

The lift struts 440–447 are similarly provided with widened flaps which twist and fold against the faces of the bottles. The end struts 440 and 443 shown in FIG. 17, and the corresponding struts in the opposite row of bottle positions, are narrowed at their ends and widened in their mid sections, and are not stiffened by crease lines, so that they will twist and flex to conform to the side face of the adjacent bottle. The intermediate lift struts 441 and 442 shown, and the corresponding struts in the other bottle row, are also narrowed at their ends and widened over their lower mid portions where they cross the side faces of the bottles, and are longitudinally creased to bend their side flaps downward and give the struts longitudinal stiffness. When bottles are present, the end struts twist and flex and the flap portions of the intermediate struts fold so that widened portions of the struts lie in close conforming relation with the side faces of the bottles.

The twisting and folding of the widened or flap portions of the separator strips and the lift struts allow the bottles to stand close to each other, and provide protective separating layers between the bottles over large areas which extend substantial distances vertically along the bottles. These features also adapt the carrier to receive bottles of different shapes which may have enlargements or constrictions at different heights. While the omission of stiffening creases from the end strips 418 and 421 and the end struts 440 and 443 reduces the longitudinal stiffness of those elements, the creasing of the intermediate strips 419 and 420 and struts 441 and 442 provides adequate bracing to hold the carrier in timely erect condition for loading and for good appearance in use.

The present invention provides a manually portable bottle carrier which is a substantial improvement over the prior art. In erected condition, it securely holds two rows of bottles and provides retaining and protective elements on all four sides of each bottle, namely, the inner and outer panels at two faces and the top panel strips and the lift struts at two sides of each bottle. The carrier stands erect and trim to present an attractive appearance either empty or filled, and to adapt it for loading in automatic equipment. When in use to transport bottles, it provides lift trains which connect the lift handle to the bottom support over three paths and at different points about the periphery of each bottle. Thus, the center panels connect the handle directly to the bottom panel at the inner face of the bottle. The top and outer face panels transmit lift along the outer face of the bottle, and the two lift struts at the sides of each bottle transmit lift along both sides of the bottle and in effect form a sling extending downward and outward across the center plane of each bottle and across the bottom of the bottle along a chordal line spaced outward from that center plane. The lift struts form an important feature of the structure, both in its lifting function and in retaining and protecting each bottle at both sides. These results are obtained with minimum use of space between the bottles.

Further, the carrier is easy and economical to manufacture. It can be formed entirely of a small number of die cut blanks of flat sheet stock, without substantial forming of bottle-receiving pockets, and can be assembled by a small number of simple steps.

Still further, the carrier can be erected and collapsed repeatedly and easily, as desired for manufacture, shipping and storage in flat condition, and for use in erected condition. The geometry of the relationship and movement of the carrier elements not only provides effective operation but permits variation, as exemplified by the embodiments shown, to suit other requirements, such as good appearance, ample printing, and display space.

The carrier is especially adapted to be made of plastics material and to make good use of the advantageous properties of such material, but can be made of other sheet stock.

What is claimed is:

1. A carrier for bottles or the like in two rows of one or more per row, comprising two bottom panels for supporting the bottoms of the bottles, an outer face panel extending upward from the outer edge of each bottom panel and connected at the top to a top panel extending inward to a central position and having one or more bottle-receiving openings therein, handle means above such central position, center panel means to which the bottom panels are connected at their inner edges and which extends upward between the rows, said handle means being connected to said center panel means, lift struts connected to the bottom panels at points spaced longitudinally of the bottle rows on such bottom panels and within the outer halves of the bottom panels, the struts connected to each bottom panel extending upward and inward across the center plane of the bottle row on such bottom panel and having their upper ends connected for lift by said handle means.

2. A carrier as in claim 1 in which said center panel means is connected for lift by said handle means.

3. A carrier as in claim 1 in which each bottle row contains a single bottle portion and struts are located at opposite sides of the bottle position so as to confine the bottom of the bottle against movement longitudinally of the bottom panel.

4. A carrier as in claim 1 in which two struts are respectively located at the ends of each bottom panel.

5. A carrier as in claim 4 in which each bottle row contains a plurality of bottle positions, further comprising an additional lift strut between at least one pair of adjacent bottle positions in the bottle row, to separate the adjacent bottle positions near the bottoms of the bottles.

6. A carrier as in claim 5 in which each bottom panel is integrally joined to a center panel and both are parts of the same sheet of stock material, and the struts connected to each bottom panel are integral therewith and cut from the same sheet of stock material.

7. A carrier as in claim 6 in which the center panels comprise separate sections at different bottle positions, bordered by slots in the sheet stock, and the lift struts are formed of material from such slots.

8. A carrier as in claim 5 which includes lift struts between adjacent bottle positions, said struts being made from flat sheet stock and bent on longitudinal bend lines so as to have an angular cross section adapted to be yieldingly collapsed by pressure between bottles in such two positions.

9. A carrier as in claim 1 in which each bottom panel is integrally joined to a center panel and both are parts of the same sheet of stock material, and the struts connected to each bottom panel are integral therewith and cut from the same sheet of stock material.

10. A carrier as in claim 9 in which the struts are cut from material contiguous in the sheet stock with the sides of the bottom and center panels over at least a portion of their length.

11. A carrier as in claim 1 in which each bottle row contains a plurality of bottle positions and which includes separator strips between adjacent bottle-receiving openings in the top panel, said strips being made from flat sheet stock and bent on longitudinal bend lines so as to have an angular cross section adapted to be yieldingly collapsed by pressure between bottles in such adjacent openings.

12. A carrier as in claim 1 in which said lift struts are formed with longitudinal stiffening bend or crease lines so as to constitute stiff strut elements in the erected condition of the carrier and thereby interact with other elements of the carrier to hold it erect.

13. A carrier as in claim 1 in which said handle means comprises handle layers connected respectively to the upper edge of said center panel means and to the upper ends of said lift struts.

14. A carrier as in claim 13 in which at least one of said handle layers is movable relative to the central upper edges of the top panel to accommodate collapsing movement of the carrier panels.

15. A carrier as in claim 14 in which both said center-panel and lift-strut handle layers are so movable.

16. A carrier as in claim 13 in which said handle means includes a handle layer connected to said top panels.

17. A carrier as in claim 14 in which said handle means includes a handle layer connected to said top panels and each movable handle layer is slidable relative to such top panel handle layer.

18. A carrier as in claim 1 in which each top panel and outer face panel form a first pair of sides of a quadrilateral of which an opposite pair of sides is formed by the adjacent struts and that portion of the bottom panel between such struts and the outer panel, said two pairs of sides have different lengths, and means is provided to allow the upper end of one of said pairs of sides to move relative to the other to accommodate collapsing of said two pairs of sides to a flattened condition.

19. A carrier as in claim 18 in which said first pair of sides is longer than the second and said last-named means provides for downward movement of the second pair of sides relative to the upper end of the first pair.

20. A carrier as in claim 19 with the addition of means providing for upward movement of the center panel relative to the upper end of the first pair of sides.

21. A carrier as in claim 1 in which each top panel and outer face panel form a first pair of sides of a quadrilateral of which an opposite pair of sides is formed by the adjacent struts and that portion of the bottom panel between such struts and the outer panel, said two pairs of sides have the same lengths so that said pairs of sides can collapse to a flattened condition without relative movement of the sides at the ends of the collapsed quadrilateral, and means is provided allowing for upward movement of the center panel relative to the upper ends of the pairs of sides to accommodate collapsing movement of the panels forming said quadrilateral.

22. A carrier as in claim 1 in which said handle structure comprises a plurality of layers, said center panel being connected to one handle layer and said lift struts being connected to another handle layer, said carrier being collapsible by relative movement of parts thereof which includes upward swinging movement of its bottom panels about their outer edges, one of said handle layers being vertically movable relative to the other so as to allow such collapsing movement.

23. A carrier as in claim 22 in which each top panel and outer face panel form a first pair of sides of a quadrilateral of which an opposite second pair of sides is formed by the adjacent struts and that portion of the bottom panel between such struts and the outer panel, and said two pairs of sides have different total lengths.

24. A carrier as in claim 23 in which said first pair of sides has a longer total length greater than that of the second pair of sides, and the handle layer connected to the struts is movable downward relative to the upper edge of the top panels as the carrier is collapsed so as to permit the two pairs of sides to be collapsed against each other.

25. A carrier as in claim 24 in which said handle means includes a handle layer connected to the top panels, the center panel handle layer being movable upward and the lift strut handle layer being movable downward relative to said top panel handle layer as the carrier is collapsed.

26. A carrier as in claim 24 with the addition of means to lock said handle layers against relative vertical movement so as to lock the carrier in erected condition.

27. A carrier as in claim 22 in which each top panel and outer face panel form a first pair of sides of a quadrilateral of which an opposite second pair of sides is formed by the adjacent struts and that portion of the bottom panel between such struts and the outer panel, and said two pairs of sides have substantially equal total lengths so as to permit the two pairs of sides to be collapsed against each other without relative movement between the ends of the lift struts and the upper edge of the top panel side of the quadrilateral.

28. A carrier as in claim 27 in which said lift-strut handle layer is connected to the upper edges of the top panels and the center panel handle layer is movable upward relative such lift-strut handle layer as the carrier is collapsed.

29. A carrier as in claim 22 with the addition of means to lock said handle layers against relative vertical movement so as to lock the carrier in erected condition.

30. A carrier as in claim 29 in which said handle layers include hand grip openings, said handle locking means comprises a flap connected to one of the handle layers and bendable over the top of another handle layer and through the hand grip openings of said layers to form a lift surface across the layers in the hand grip openings thereof.

31. A carrier as in claim 30 in which the flap includes laterally projecting ears which, when the flap is in locking position, engage against the back face of a handle layer to secure the flap in such position.

32. Intermediate blanks adapted for assembly to form a bottle carrier as in claim 1, comprising two die-cut sheet blanks each having a first half including a bottom panel extending between an outer junction line at the end of such half to an inner junction line spaced therefrom, a center panel portion integral with the bottom panel at the inner junction line, and lift struts integral with the bottom panel at an intermediate junction line within the outer half of the bottom panel and formed from material contiguous in the sheet stock with the sides of the center panel portions and of the bottom panel portion between said intermediate and inner junction lines, and handle means integral with the blank at the outer end of said first half, each blank also having a second half including an outer panel integral with the bottom panel at the outer junction line and extending to an upper junction line, a top panel joined thereto at such upper junction line, and handle means integral with the blank at the outer end of said second half, said two blanks being adapted to be laid one on top of the other with the panels and struts of the first halves in registry for attachment of the blanks to each other at selected points, and to have the second halves folded about the outer junction lines and against the exposed faces of the attached first halves in registry for attachment at selected points.

33. Intermediate blanks as in claim 32 in which the handle means at the ends of the blank are handle layers integral with the blanks, the handle layers of the second halves of the blanks being joined to the top panels thereof, and the handle layer of at least one of the first halves of the blanks being joined to the center panel portion thereof.

34. Intermediate blanks as in claim 33 in which the handle layer of one of the first halves is joined to the ends of the lift struts of such half.

35. Intermediate blanks as in claim 33 in which the handle layers of both first halves are joined to the center panel portion thereof, with the addition of a supplemental blank comprising a handle layer adapted to be connected to the struts of at least one of said first halves.

36. Intermediate blanks as in claim 33 in which said handle layers contain hand grip openings and one of the layers has a flap integrally joined thereto for locking the handle layers together in an assembled and erected carrier.

37. Intermediate blanks as in claim 32 with the addition that in at least one of said two blanks stock material at the outer ends of the lift struts is cut away to form slot openings, and parts of the material of such slot openings is left detachably connected to the blanks to form spacers in position to be attached between the handle layers of the second halves of the blank to space the same from each other and define guideway means for sliding movement of blank portions between such slots.

38. A carrier for bottles or the like in two rows of one or more per row, comprising two bottom panels for supporting the bottoms of the bottles, handle means in an upper central position, an outer face panel extending upward from the outer edge of each bottom panel and connected by spaced strips to said handle means, center panel means to which the bottom panels are connected at their inner edges and which extends upward between the rows, said handle means being connected to said center panel means, lift struts connected to the bottom panels at points spaced longitudinally of the bottle rows on such bottom panels and within the outer halves of the bottom panels, the struts connected to each bottom panel extending upward and inward across the center plane of the bottle row on such bottom panel and having their upper ends connected to said handle means for lift by said handle means.

39. A carrier as in claim 38 which includes a spaced strip and a lift strut at each side of each bottle position in each row, to separate and confine the bottles in such positions.

40. A carrier for bottles or the like in two rows of one or more per row, comprising bottom, center, outer and top panels forming two bottle-receiving containers on opposite sides of a handle plane, handle means in such plane connected to such containers at the top thereof, said center panels being connected to said bottom panels and said handle means, said container-defining panels having a quadrilateral configuration in end elevation, and being collapsible by folding opposite pairs of sides thereof against each other, and lift struts coupled to and extending from said handle means diagonally downward and outward across the center planes of the bottle positions in such containers and having lift connections to the bottom panels of such quadrilateral containers at points within the outer halves of the bottle positions, at least one of said pairs of sides and said lift struts being variable in effective length to permit such collapsing.

41. A carrier for bottles or the like, comprising container means for containing one or more bottles, said means including a plurality of panels and having an erected condition and being movable to a collapsed condition, a lift handle for said carrier comprising a plurality of handle layers connected to different panels of the container means, and slidable relative to each other upon collapsing of the container means, said handle layers having hand grip openings which come into registry when the container is in erect condition and being operative to hold the container in erect condition when secured against relative sliding from such registry relation, and a handle flap connected to the top edge of a handle layer and foldable downward, thence through the registering hand grip openings of the handle layers and thence upward, so as to secure the relatively slidable layers against sliding movement and thereby secure the carrier in erected condition, said handle flap having ears at its lateral edges which extend laterally from the flap so as to overlap handle layer face areas at opposite ends of the hand grip openings and thereby secure the flap in such folded condition.

42. A carrier for bottles or the like as in claim 41 with the addition that the ears of the flap have reversely extending lobes which in the folded condition of the flap extend downward along said face areas in an opposite direction from the end of the flap so as to bias such end to an upward folded position.

* * * * *